US006334221B1

(12) United States Patent
Hope

(10) Patent No.: US 6,334,221 B1
(45) Date of Patent: Jan. 1, 2002

(54) SLEEPING BAG

(76) Inventor: Stephen Ross Hope, P.O. Box 38-401 Howick, Auckland (NZ)

( * ) Notice: Subject to any disclaimer, the term of this patent is extended or adjusted under 35 U.S.C. 154(b) by 0 days.

(21) Appl. No.: 09/381,981

(22) PCT Filed: May 7, 1998

(86) PCT No.: PCT/NZ98/00054

§ 371 Date: Oct. 6, 1999

§ 102(e) Date: Oct. 6, 1999

(87) PCT Pub. No.: WO98/51199

PCT Pub. Date: Nov. 19, 1998

(30) Foreign Application Priority Data

May 9, 1997 (NZ) ..... 314779

(51) Int. Cl.[7] ..... A41D 15/04
(52) U.S. Cl. ..... 2/69.5; 2/69
(58) Field of Search ..... 2/69.5, 69, 458, 2/456, 4, 84, 85, 86, 87, 93, 94, 79; 5/413 R

(56) References Cited

U.S. PATENT DOCUMENTS 3,924,273 A * 12/1975 Donovan ..... 2/69.5
3,965,487 A * 6/1976 Mazur ..... 2/69.5
4,103,377 A * 8/1978 Mayer et al. ..... 5/343
4,125,910 A * 11/1978 Nicholai ..... 5/343
4,158,892 A * 6/1979 Gonzales ..... 2/69.5
4,206,512 A * 6/1980 Osborne ..... 2/69.5
4,507,805 A * 4/1985 Calutoiu ..... 2/69.5
4,532,654 A * 8/1985 Sigismonde ..... 2/69.5
4,574,397 A * 3/1986 Dennard ..... 2/69.5
4,575,876 A * 3/1986 Weaver ..... 2/69.5
4,703,521 A * 11/1987 Asher et al. ..... 2/69
4,787,105 A * 11/1988 Phillips et al. ..... 5/413
4,811,429 A * 3/1989 Perez ..... 2/83
4,884,303 A * 12/1989 Scherer ..... 5/413
4,894,878 A * 1/1990 Roach ..... 5/413
4,998,296 A * 3/1991 Stames ..... 2/69.5
5,131,096 A * 7/1992 Olson ..... 2/75
5,226,193 A * 7/1993 Chen ..... 2/69.5
5,357,635 A * 10/1994 Lemoine ..... 2/84
5,542,123 A * 8/1996 DiPietro ..... 2/80
5,560,043 A * 10/1996 Armstrong ..... 2/69.5
5,785,219 A * 7/1998 Kraft ..... 224/576
5,815,833 A * 10/1998 Kuo ..... 2/69.5
6,018,830 A * 2/2000 Howe ..... 5/413 R
6,032,285 A * 3/2000 Densen ..... 2/2
6,061,831 A * 5/2000 Rudolph et al. ..... 2/69.5

FOREIGN PATENT DOCUMENTS

FR 2397799 * 3/1979 ..... 2/69.5
NL 2910639 * 9/1980 ..... 2/69.5

* cited by examiner

*Primary Examiner*—John J. Calvert
*Assistant Examiner*—Alissa L. Hoey
(74) *Attorney, Agent, or Firm*—Steve McNichols; McNichols Randick O'Dea & Tooliatos LLP

(57) ABSTRACT

A sleeping bag (10) which includes a main body (11) for substantially enclosing the trunk of a user, and at least one body portion (12*a*, 12*b*, 13*a*, 13*b*) attached or attachable to the main body (11), the at least one body portion (12*a*, 12*b*, 13*a*, 13*b*) being adapted to separately enclose substantial portions of other body part(s) of the user. The at least one body portion (12*a*, 12*b*, 13*a*, 13*b*) may be integrally formed with the main body (11) or releasably attachable to same. The provision of the at least one body portion (12*a*, 12*b*, 13*a*, 13*b*) allows for greater mobility of a user while still within the sleeping bag (10). Furthermore, the embodiment which has at least one releasably attachable body portion (12*a*, 12*b*, 13*a*, 13*b*) allows for a degree of flexibility in terms of use and accessories.

18 Claims, 4 Drawing Sheets

SLEEPING BAG

TECHNICAL FIELD

This invention relates to improved sleeping bags. More particularly, it relates to sleeping bags which offer advantages in terms of mobility and utility, and/or safety of the user when the sleeping bag is occupied, in comparison to conventional, substantially rectangular sleeping bags.

BACKGROUND ART

Sleeping bags in one form or another are known, and have been in wide spread usage for many years. The main advantage of sleeping bags is that they provide transportable, versatile bedding. Sleeping bags are perhaps in most common usage by those in particular need of portable bedding, for example people involved in outdoor recreation, as they can be used in the outdoors when camping, tramping, mountaineering and so on. Travellers such as backpackers are also predominant sleeping bag users. However, most households also usually possess one or more sleeping bags which may be used when conventional beds or bedrooms are insufficient to accommodate guests.

Sleeping bags have undergone significant development over the years in terms of the materials from which they are made. For example, they are more insulated, or can be packed up into much smaller bags that are easier to accommodate in a backpack. However, sleeping bag shape or design has not developed to a like degree, if at all. Most sleeping bags are still traditionally of a substantially elongate rectangular shape, with sometimes a slight tapering towards the feet, and/or the provision of a portion to support the head.

It would be desirable to provide sleeping bags that exhibit design advantages such that, for example, they can be used not only in a prone sleeping position, but permit movement of the occupier, and partial or full body coverage when doing so. This would further enhance safety for the user, obviating stumbling or tripping. It would also be desirable to provide a sleeping bag that provides flexibility in terms of use and accessories.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a sleeping bag including:

a) a main body for substantially enclosing the trunk of a user, b) at least two body part portions attached or attachable to said main body, each of said at least two body part portions being adapted to enclose, partially or fully, at least one body part of the user, wherein one of said body part portions includes at least one leg portion integrally formed with the main body, and wherein another of said body part portions includes at least one arm portion releasably attachable to the main body.

According to a further aspect of the present invention there is provided a sleeping bag, substantially as described above, wherein said at least two body part portions further includes a head portion.

According to a further aspect of the present invention there is provided a sleeping bag, substantially as described above, wherein said head portion is releasably attachable to the main body.

According to a further aspect of the present invention there is provided a sleeping bag, substantially as described above, wherein there is provided a substantially water resistant or water proof seal between said main body and the releasably attachable body part portion(s), when attached.

The term body part(s) as used herein (and to which the body part portions are adapted to enclose) may include limbs (arms/hands and/or legs/feet) and/or the head/neck portions of a user.

The main body of the sleeping bag may be of any size, shape or configuration as required or as desired, or as dictated by the intended use of the sleeping bag or the dimensions of the user. Given that the main body is adapted to substantially enclose the trunk of a user, it is envisaged that in preferred embodiments the main body may be substantially square or rectangular in shape.

The body part portions may include leg portions and/or arm portions and/or a head portion.

Any combination of body part portions may be utilised as required or as desired, or as dictated by the conditions under which the sleeping bag is to be used.

For example, if the user required the mobility of his/her legs, but not the arms, then the sleeping bag may comprise a main body with leg portions, with the user's arms being enclosed within the main body. Alternatively, if the user required the mobility of his/her arms, but not the legs, the sleeping bag may be provided with a main body with arm portions, with the legs being enclosed within the main body of the sleeping bag.

In either of the above two embodiments, the sleeping bag may also be provided with a head portion to support and/or substantially enclose the head and/or neck.

In one embodiment, the body portions may be releasably attachable to the main body, and may be attached and removed as or when required or desired.

Any suitable means may be utilised for releasably attaching the body part portions to the main body. For example, the releasable attachment means may be in the form of zipper fasteners, that is, the body part portions may be provided with zipper fasteners to engage with appropriate zipper fastening strips located on the main body in an appropriate place.

Alternatively, the releasable attachment means may be in the form of VELCRO™ brand releasable fastening strips located on the body part portions and main body where appropriate.

Another alternative would be the use of flaps provided with domes, which in turn are adapted to be releasably attachable to corresponding rivets.

As used herein, and with respect to the embodiment with releasably attachable body part portions, the term leg portions shall be deemed to include portions able to enclose any part of the leg area of a user and may accordingly be adapted so as to detach from the approximate position of substantially either the thighs, knees, calves, ankles and/or feet.

The releasably attachable leg portions may be made of any material considered suitable, and may be changeable depending on the users' requirements. For example, during warmer seasons, the leg portions may be made of mosquito netting, lightweight cotton, silk or other materials that increase comfort and permit body heat to disperse more easily. Similarly, during colder seasons the leg portions may be made of heavier and more insulated material, such as the known materials sleeping bags are presently made of which are designed for cold conditions.

Alternatively, or additionally, the leg portions may be adapted to include part or whole feet portions, such as preformed portions to accommodate the feet, or even shoes, waders, boots or durable soles. If intended for use in colder climates, such as in snow, the feet portions may further be adapted to contain insulation, such as sheepskin or other suitable insulation materials. The soles of the feet portions may also include studs, crampons or similar, if deemed appropriate.

As used herein, and with respect to the embodiment with releasably attachable body part portions, the term arm portions shall be deemed to include portions able to enclose any part of the arm area of a user, and may accordingly be adapted so as to detach from the approximate position of substantially either the bicep, elbow, forearm, wrist and/or hands.

The releasably attachable arm portions may similarly be made of the same material as the body of the sleeping bag or alternative materials depending on the requirements of the user, as described above with respect to the releasably attachable leg portions (and for convenience need not be repeated here).

Furthermore, the arm portions may similarly be adapted to include part or whole hand portions such as gloves and mittens.

The feet and/or hand portions may be integrally formed with respect to the leg portions and arm portions respectively. Alternatively, the feet portions and/or hand portions may be releasably attachable to the leg portions and arm portions respectively. Any suitable releasable attachment means may be utilised, for example those described previously for releasably attaching the body part portions to the main body.

There may be provided water resistant or water proof seals between the releasably attachable portions (whether it be the body part portions and the main body, or the feet/hand portions to the leg/arm portions). Any suitable water resisting or proofing means may be utilised as appropriate. For example, if the releasable attachment means are in the form of zip fasteners, there may additionally be provided a flap to cover the join, the flap being releasably attached across the join either by the use of domes or another zip fastener (similar to some rain coats which have one or more zippers/flaps in order to substantially water proof the front of the rain coat).

It is envisaged that the sleeping bag, or the components comprising same, may be comprised of any suitable material as required or as desired. Such materials may or may not be substantially water resistant or water proof, depending upon requirements.

Similarly, it is envisaged that the feet and/or hand portions may be comprised of a substantially water resistant or water proof material if required or desired.

The head portion may also be adapted to suit the requirement of the user, and may for example include features such as a mosquito net to zip over and around the head, a waterproof covering, a specially padded head covering to substitute for a pillow, or any other suitable adaptation enabling greater flexibility of use and mobility and comfort of the user. The head portion may also be provided with a draw string to substantially enclose the head of a user when or as appropriate.

The head portion may also be releasably attachable to the main body as required or as desired. For example, if a user of the sleeping bag had access to a pillow, the head portion may be removed. If however the user did not have access to a pillow, the head portion may be retained, and especially so if it has padding to substitute for a pillow.

The releasable attachment means for the detachable portions, as described herein, may further be adapted to enhance user comfort. For example, chill flaps, or draft-reducing features could be used in conjunction with the fastening means, for example to eliminate passage of drafts, heat, or moisture through the region where the detachable portions join the main sleeping bag, and/or throughout the sleeping bag.

The main entry to the main body of a sleeping bag of the present invention may be accessed or accessible by any suitable means (the term main entry does not refer to the normal aperture allowing a user to slide into a sleeping bag), for example via a conventional zip along one side of the bag.

Alternatively, the main entry may be provided by a zip fastener running substantially the length of the trunk portion, and preferably along a substantially middle, front portion thereof. Having the main entry in such position allows for ease of entry and exit by a user, as the zip fastener would be similar to the zip running down the front of a jacket or the like.

The sleeping bag may include a gusset to strengthen or aerate the region where the leg portions join the main body (ie, in the region of the crotch area of the user). Whilst the complete division of the lower half of the sleeping bag to the crotch of the user may provide optimal mobility for the user when inside the sleeping bag, alternatively the division may extend only to lower sites of the leg area.

The leg portions, may taper such that excess material is not in the area of each foot of the user.

Further features enhancing the fitting of the sleeping bag to the body of the user may also be incorporated, such as a drawstring the main body of the sleeping bag. Hence, a user can draw the sleeping bag around his/her trunk region so as to ensure the sleeping bag does not through gravity or natural body movement slip down the body of the user, and also to ensure that the sleeping bag may fit snugly around a user, which has advantages in keeping the user warm.

Furthermore, the sleeping bag may be provided with pockets which may preferably be resealable (preferably by the use of zip fasteners). Such pockets may be utilised for storing important items during sleep (for example money, car keys, watch, torch and the like). Such pockets may be provided on any part of the sleeping bag, and any number of such pockets may be provided as required or as desired. Such pockets may be lockable by the provision of a small padlock and key.

It can be appreciated that the embodiments of the sleeping bag of the present invention permit greater utility, mobility and/or comfort for the user depending on their specific requirements.

It will also be appreciated that the sleeping bag may be used with part or all of the releasably attachable portions in place or completely removed, the limbs and/or head being able to be free of the sleeping bag uncovered if so required or desired.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
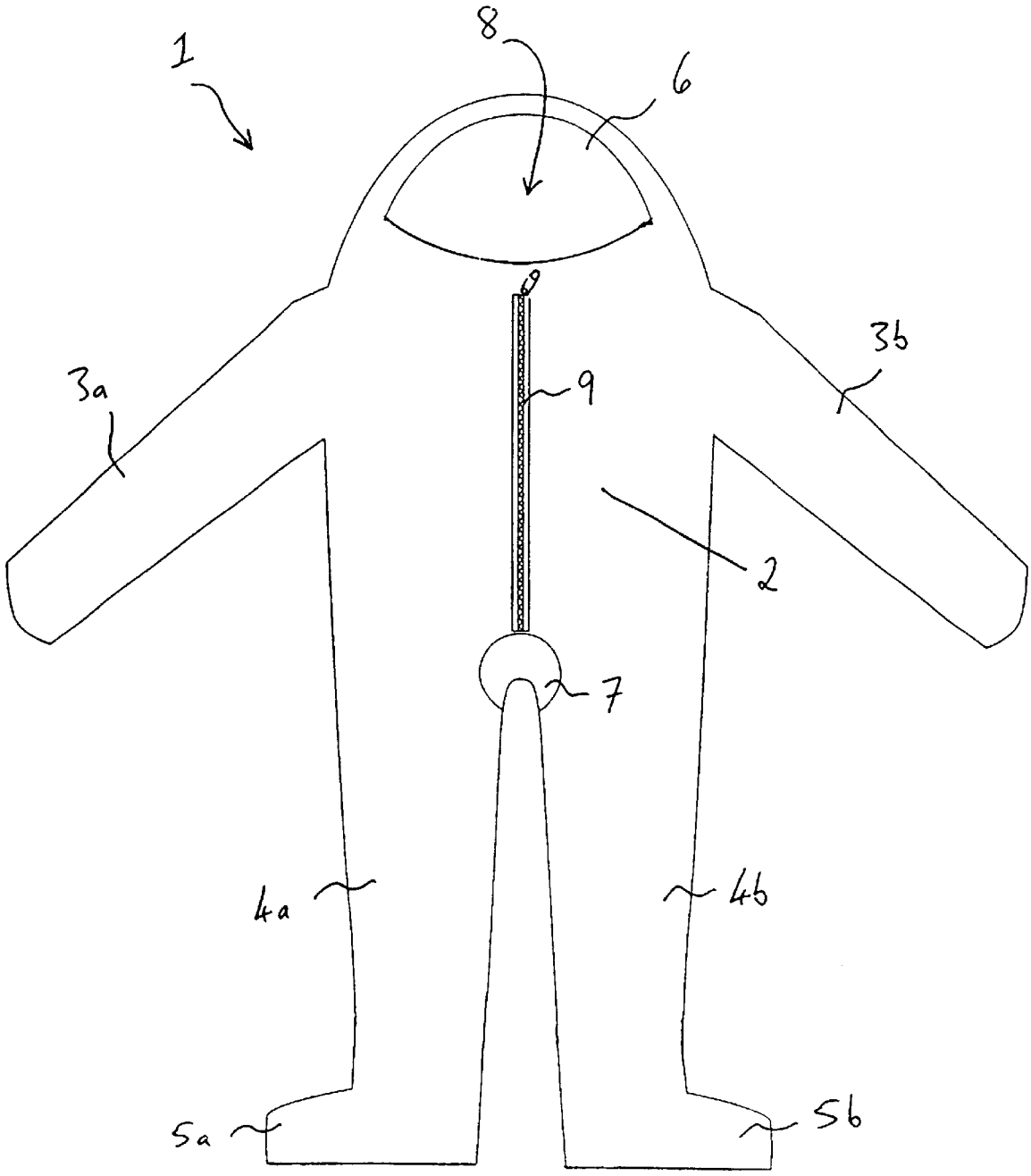
FIG. 1 is a front view of a sleeping bag, being one possible embodiment of the present invention.

Having regard to FIG. 1 there is shown a sleeping bag generally indicated by arrow 1.

The sleeping bag 1 comprises a main body 2 for substantially enclosing the trunk of a user. The sleeping bag 1 is provided with arm portions 3*a,b* and leg portions 4*a,b*.

The arm portions 3*a,b* and the leg portions 4*a,b* are adapted to separately enclose the arms and legs of a user, and separately from the main body 2.

The arm portions 3*a,b* and leg portions 4*a,b* are integrally formed with respect to the main body 2.

The leg portions 4*a,b* are provided with specially shaped feet portions 5*a,b* to accommodate the feet of a user.

There is also provided an integrally formed head portion 6 for supporting the neck and/or head of a user.

The sleeping bag 1 is provided with a gusset 7 in substantially the region of the crotch area of a user, and specifically in the region between the division of the leg portions 4*a,b*.

The main entry into the sleeping bag 1 (other than the usual sleeping bag aperture indicated by arrow 8) is provided by a zip fastener 9 which runs substantially the length of the main body 2, and substantially down the front middle portion thereof.

The sleeping bag 1 may be comprised of any suitable sleeping bag material, of which there are many different types presently known and which are applicable to different user conditions, and need not be described in further detail herein.

Figure 2:
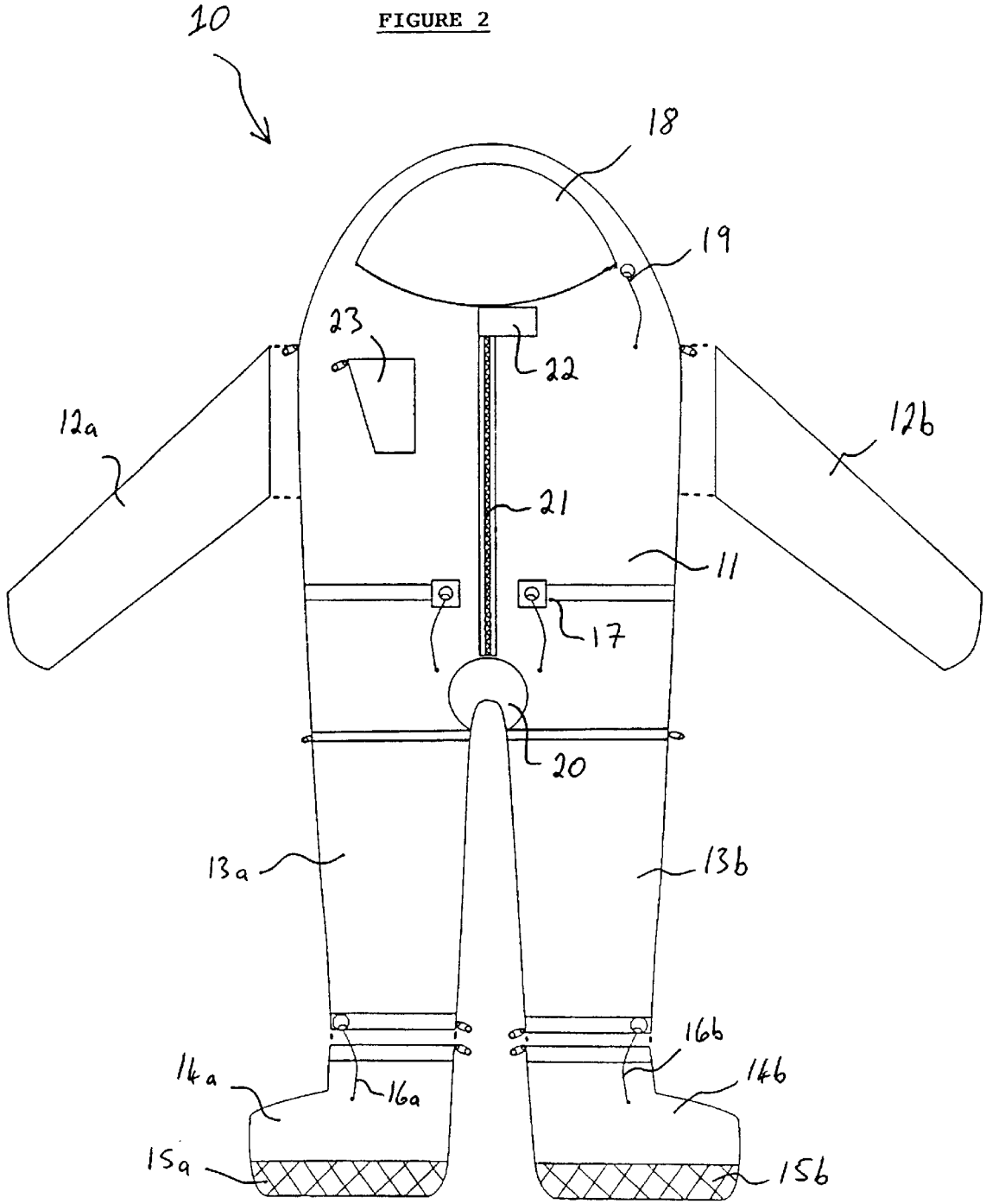
FIG. 2 is an exploded front view of a sleeping bag, being a further embodiment of the present invention.

Having regard to FIG. 2, there is shown another embodiment of a sleeping bag generally indicated by arrow 10. The sleeping bag comprises a main body 11, releasably attachable arm portions 12*a,b* and releasably attachable leg portions 13*a,b*.

The arm portions 12*a,b* and the leg portions 13*a,b* are releasably attachable by the use of zip fasteners (not clearly shown).

The leg portions 13*a,b* are provided with releasably attachable feet portions 14*a,b*, the feet portions 14*a,b* being releasably attachable to the leg portions 13*a,b* by the use of zips (not clearly shown).

The feet portions 14*a,b* are specifically moulded to a shape to accommodate the feet, and are further provided with rubber soles 15*a,b* to assist the user when walking about in the sleeping bag 10.

The lower part of the leg portions 13*a,b* are provided with draw strings 16*a,b* so that the leg portions 13*a,b* may be pulled tightly around the lower leg of the user.

Similarly, the main body 11 is provided with a draw string 17 to enable the sleeping bag to be pulled tightly around the trunk of the user, when or as required or desired.

The sleeping bag 10 is also provided with a head portion (which is not releasably attachable) indicated by arrow 18. The head portion 18 is provided with a substantial about of padding (not shown) to act as a pillow or to otherwise cushion the neck/head of the user. The head portion 18 is also provided with a draw string 19 so that the head portion 18 may be pulled substantially around the head of the user when or as required.

The sleeping bag 10 is provided with a strengthening gusset 20 in the region where the leg portions 13*a,b* divide.

The main entry into the sleeping bag 10 is provided by a zipper 21 with a resealable flap 22 (which is resealable by virtue of being provided with VELCRO™ brand fastening strips).

The sleeping bag 10 is also provided with a pocket 23 (resealable by the use of a zip fastener). The pocket 23 may be utilised to store important items such as money, car keys, watch, torch or similar.

Figure 3:
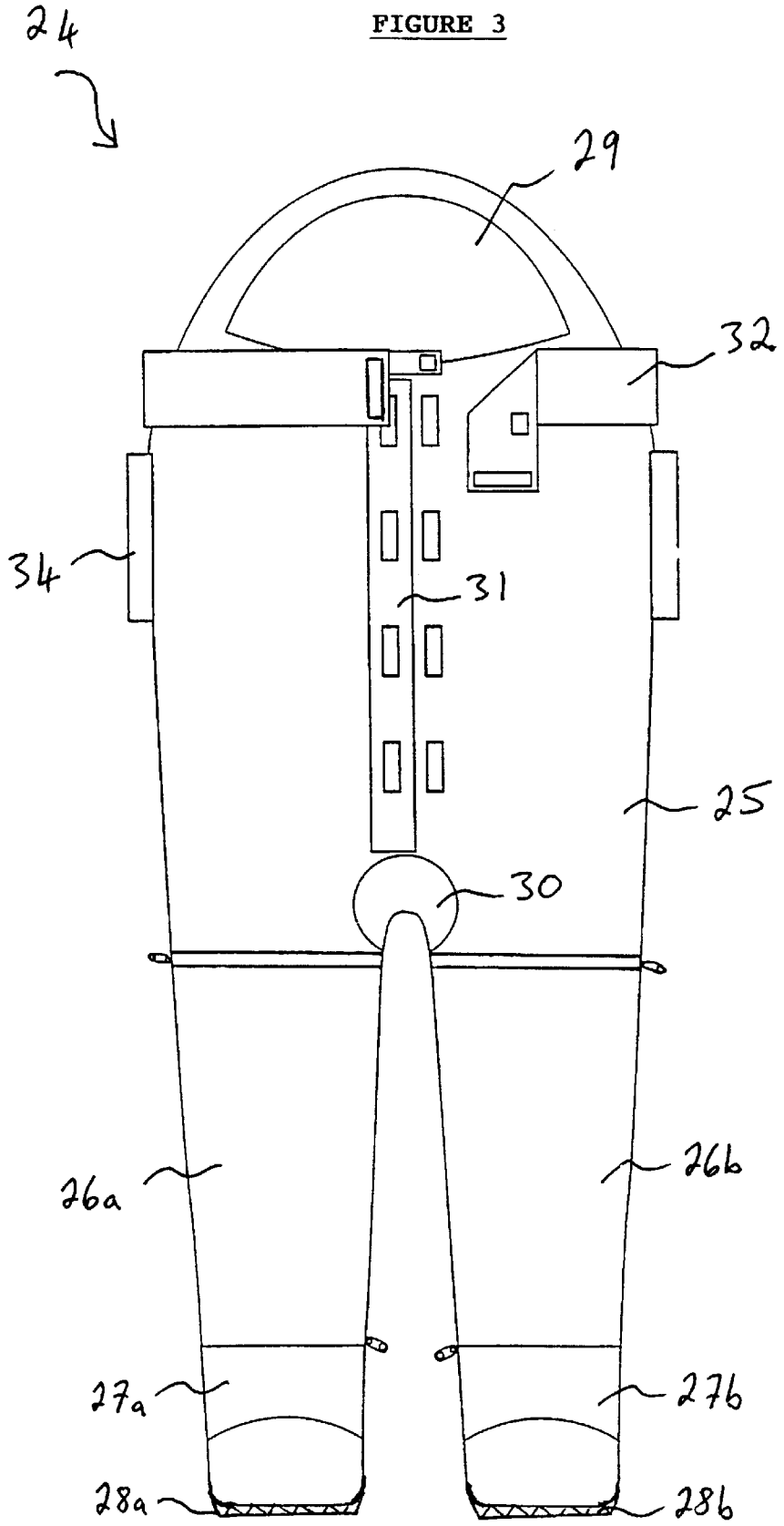
FIG. 3 is a front view of a sleeping bag, being yet a further embodiment of the present invention.

Having regard to FIG. 3, there is shown another embodiment of the present invention in the form of the sleeping bag generally indicated by arrow 24.

The sleeping bag 24 comprises a main portion 25 and releasably attachable leg portions 26*a,b*. The leg portions 26*a,b* are further provided with releasably attachable feet portions 27*a,b* which include rubber soles 28*a,b*.

The feet portions 27*a,b* are specifically adapted to accommodate the feet of a user.

The leg portions 26*a,b* are attachable to the main body 25 by the use of zip fasteners (not clearly shown), as are the feet portions 27*a,b* releasably attachable to the leg portions 26*a,b*.

There is provided an integrally formed head portion 29, which includes padding (not shown) to act as a pillow and cushion the head/neck of a user.

The sleeping bag 24 is provided with a strengthening gusset 30 in the region where the leg portions 26*a,b* divide.

The main entry into the sleeping bag 24 is provided by a zip fastener (not shown). The zip fastener is covered by chill flaps 31 which are releasably sealable over the top of zip fastener by the use of VELCRO™ brand fastening strips.

There is further provided a top flap 32 for sealing the top region of the sleeping bag 24 once the zip fastener has been done up and the chill flaps 31 scaled over top. Such flaps help to keep out drafts and moisture.

There are no arm portions depicted in the embodiment in FIG. 3. However, with respect to FIG. 4, it may be seen that there is an aperture covered by the zipper 33 which would enable the attachment of arm portions when or as appropriate or as required or desired. The zipper 33 is covered by a resealable flap 34 which serves to keep draft and moisture out when arm portions are not attached, or to cover the join when they are attached.

The flaps 34 are releasable attachable by the use of VELCRO™ brand fastening strips.

Figure 4:
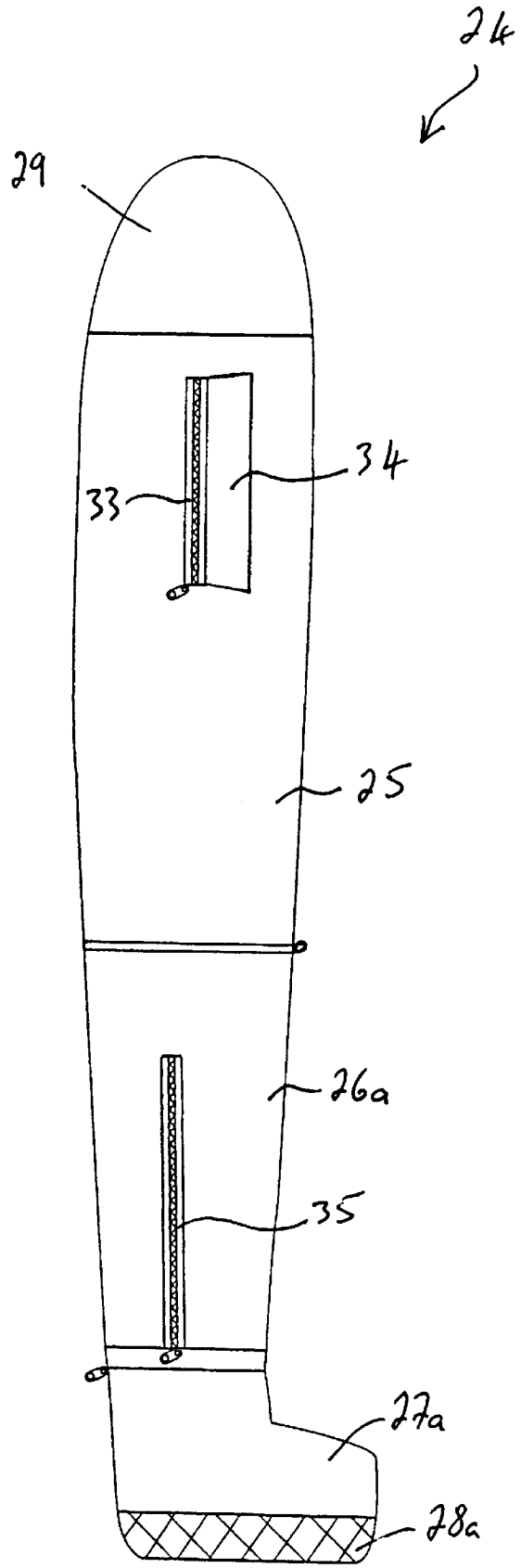
FIG. 4 is a side view of the embodiment shown in FIG. 3.

Having regard to FIG. 4, the leg portions 26*a,b* are further provided with a zipper 35 which enables the user to readily withdraw his/her legs out of the feet portions 27*a,b*, or leg portions 26*a,b*. Moreover, the zipper 35 allows for a user to get into the sleeping bag in his/her shoes or boots which may be retained within the feet portions 27*a,b* (or alternatively the feet portions 27*a,b* may be removed and the boots merely protruding from the lower portion of the leg portions 26*a,b*.

In the embodiment shown in FIGS. 3 and 4, the user may sleep with his/her arms within the main portion 25 of the sleeping bag 24, or alternatively may undo the zipper(s) 33 whereby the arms may protrude from the main portion 25 of the sleeping bag 24.

It may be envisaged that the sleeping bag as depicted in the drawings provides a user with a greater degree of flexibility, especially having regard to movement. That is, in all of the embodiments depicted in the drawings the user may walk around whilst still in the sleeping bag. Furthermore, in the embodiments where the arm and leg portions are detachable, the sleeping bag may be made up of portions of different materials as required or as desired or as dictated by the environment within which the sleeping bag is to be used.

Aspects of the present invention have been described by way of example only and it should be appreciated that modifications and additions may be made thereto without departing from the scope thereof as defined in the appended claims.

The claims defining the invention are:

1. A sleeping bag including:

a) a main body for substantially enclosing the trunk of a user, b) at least two body part portions in communication with, attached or said main body, each of said at least two body part portions being adapted to enclose, partially or fully, at least one body part of the user, wherein one of said body part portions includes at least one leg portion integrally formed with the main body, and wherein another of said body part portions includes at least one arm portion releasably attachable to the main body.

2. A sleeping bag as claimed in claim 1 wherein said at least two body part portions further includes a head portion.

3. A sleeping bag as claimed in claim 2, wherein said head portion is releasably attachable to the main body.

4. A sleeping bag as claimed in claim 1, wherein there is provided a substantially water resistant or water proof seal between said main body and the releasably attachable body part portion(s), when attached.

5. A sleeping bag as claimed in claim 4 wherein said substantially water resistant or water proof seal is in the form of or provided by a releasably sealable flap provided on either the main body or the releasably attachable body part portion(s), and in the region of the attachment.

6. A sleeping bag as claimed in claim 1, wherein one or more of the releasable attachable body part portion(s) are comprised of a different material(s) to said main body.

7. A sleeping bag as claimed in claim 1, wherein there is provided a gusset in the region where the at least two leg portions meet the main body.

8. A sleeping bag as claimed in claim 1, wherein the main body is provided with a drawstring.

9. A sleeping bag as claimed in claim 1, wherein said at least one leg portion is provided with feet portion(s) to substantially enclose the feet of the user.

10. A sleeping bag as claimed in claim 9, wherein said feet portion(s) are provided with a drawstring to enable a user to draw the feet portion(s) around his/her feet or lower leg.

11. A sleeping bag as claimed in claim 1, wherein said at least one arm portion is provided with hand portion(s) to substantially enclose the hands of the user.

12. A sleeping bag as claimed in claim 1, wherein said feet portion(s) and/or said hand portion(s) are comprised of a substantially water resistant or water proof material.

13. A sleeping bag as claimed in claim 1, wherein said feet portion(s) and/or said hand portion(s) are releasable attachable to said at least one leg portion and arm portion respectively.

14. A sleeping bag as claimed in claim 1 wherein said at least one leg portion is provided with a drawstring to enable a user to draw said at least one leg portion around his/her leg.

15. A sleeping bag as claimed in claim 14 wherein said drawstring is located towards a lower part of said at least one leg portion whereby the user may draw said at least one leg portion around his/her lower leg.

16. A sleeping bag as claimed in claim 1 wherein the main entry into the sleeping bag is provided by a zip fastener running substantially the length of the main body.

17. A sleeping bag as claimed in claim 16 wherein the zip fastener is located substantially along the middle front portion of the main body.

18. A sleeping bag as claimed in claim 17 wherein the main entry into the sleeping bag is provided with a substantially water resistant or water proof seal.

* * * * *

UNITED STATES PATENT AND TRADEMARK OFFICE

CERTIFICATE OF CORRECTION

PATENT NO. : 6,334,221 B1
DATED : January 1, 2002
INVENTOR(S) : Hope

It is certified that error appears in the above-identified patent and that said Letters Patent is hereby corrected as shown below:

Column 7,
Line 15, before “said main body”, delete -- attached or -- therefor.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,334,221 B1
DATED : January 1, 2002
INVENTOR(S) : Hope et al.

It is certified that error appears in the above-identified patent and that said Letters Patent is hereby corrected as shown below:

Title page,
Item [76], insert -- David Norman Hilliam, Auckland (NZ) -- therefor.

Signed and Sealed this

Seventh Day of October, 2003

JAMES E. ROGAN
*Director of the United States Patent and Trademark Office*